United States Patent [19]

Searls

[11] 4,228,556

[45] Oct. 21, 1980

[54] AUTOMATICALLY ENERGIZABLE LIFESAVING EQUIPMENT

[76] Inventor: Henry H. Searls, 5 Canyon Island Dr., Newport Beach, Calif. 92660

[21] Appl. No.: 894,692

[22] Filed: Apr. 10, 1978

[51] Int. Cl.[3] ..... B63C 9/20

[52] U.S. Cl. ..... 9/14; 9/313; 114/190

[58] Field of Search ..... 9/8.3 R, 8.3 E, 14, 9/11 R, 11 A, 311, 313; 114/190, 242, 253, 254; 116/173, 174

[56] References Cited

U.S. PATENT DOCUMENTS

| | | | |
|---|---|---|---|
| 734,118 | 7/1903 | Carley | 9/11 R |
| 988,830 | 4/1911 | Smith | 9/8.3 R |
| 3,006,309 | 10/1961 | Rowley | 114/254 |
| 3,208,586 | 9/1965 | Wilson | 114/254 X |
| 3,209,382 | 10/1965 | Scott | 9/311 |
| 3,210,494 | 10/1965 | Murdock | 9/14 X |
| 3,641,693 | 2/1972 | Pinnow | 116/173 X |
| 3,696,453 | 10/1972 | Harris et al. | 9/14 |
| 3,754,291 | 8/1973 | Harris et al. | 9/14 |
| 4,033,276 | 7/1977 | Barr | 9/14 X |
| 4,140,205 | 2/1979 | Matson | 9/14 X |
| 4,155,132 | 5/1979 | Lee | 9/14 |

FOREIGN PATENT DOCUMENTS

| | | | |
|---|---|---|---|
| 20088 | 4/1915 | Denmark | 9/14 |

*Primary Examiner*—Trygve M. Blix
*Assistant Examiner*—Winston H. Douglas
*Attorney, Agent, or Firm*—Mahoney & Schick

[57] ABSTRACT

A lifesaving apparatus for use on ships and other types of water sustained vessels which is characterized by the fact that it can be actuated by a person who has fallen overboard without the intervention of on-deck personnel. The lifesaving apparatus is mounted on a support secured to the vessel and includes among other components a life buoy; a man-overboard pole and flag; and a trailing line, which is constantly streamed astern of the vessel so that the life buoy and associated components are released from the support on the vessel when the trailing line is grasped by a man overboard.

10 Claims, 8 Drawing Figures

58
56
72
24
70
80
22
28
24
12
30
22
14
24
18
26

92
KNOTS
15
14
13
12
11
10
9
8
7
6
5
4
3
2
1
94
90
96
94
96
12
34
32
50

40
52
42
36
60
81
61
75
70
74
76

AUTOMATICALLY ENERGIZABLE LIFESAVING EQUIPMENT

BACKGROUND OF THE INVENTION

One of the greatest hazards of the sea is the loss of crew and passengers overboard and as greater numbers of relatively inexperienced crewmen and single handers undertake extended voyages, the number of a crew and passengers lost overboard increases.

In smaller cruising vessels limitations of size and accommodations entail the utilization of one man watches and if the man on watch is lost overboard, under present conditions, there is a little, if any, hope of rescue. Similar situations occur on larger commercial vessels because of the reduction of crew attributable to automation and the corresponding reduction in the number of watch personnel. Of course, single handers are very vulnerable to the dangers of going overboard.

Conventional lifesaving apparatus require the presence on deck of an individual who will throw the lifesaving apparatus from the vessel to the individual who has fallen overboard. If there is no one on deck, in most cases the individual who has fallen overboard is lost despite the fact that he may be wearing floatation gear, such as a floatation jacket.

Such loss is attributable to the fact that, once an individual falls overboard and a vessel moves out of range, he becomes an infinitesimal speck on the massive surface of the sea. Without some ancillary means of locating and identifying the man overboard, it is almost impossible to locate and rescue him.

OBJECTS AND ADVANTAGES OF THE INVENTION

It is, therefore, a primary object of my invention to provide a lifesaving apparatus which is characterized by the fact that, when a man falls overboard, the need for another person to throw him a conventional lifesaving device is eliminated. This desirable result is attained by streaming a trailing line, having one or more buoys thereupon to support or identify the line, from the lifesaving apparatus of my invention astern of the vessel and providing for the automatic release of the various components of the lifesaving apparatus when the trailing line is grasped by a man overboard.

An additional object of my invention is the provision of a lifesaving apparatus adapted to be operated by a man overboard which includes a support on the vessel, a life buoy on said support and a continuously streamed trailing line connected to said life buoy, said life buoy, in turn, being connected to said support by releasable connecting means which is capable of resisting the load impressed upon it by the towing of the trailing line astern of the vessel but which will be automatically released when the trailing line has the weight of an overboard man imposed thereupon.

Another object of my invention is the provision of a lifesaving apparatus of the aforementioned character wherein the life buoy has a man-overboard flag associated therewith consisting of a flag staff having a pennant at one end of said staff and a counterweight at the other end thereof, said staff being connected intermediate its extremities to said life buoy. Consequently, when the life buoy is dislodged from operative engagement with the support by the grasping of the trailing line by a man who has fallen overboard, the life buoy and man-overboard flag are simultaneously released. The man-overboard flag is supported by the buoyancy of the life buoy and automatically pivoted upwardly by the counterweight to dispose the pennant at the upper extremity of the staff in spaced relationship with the surface of the sea.

A further object of my invention is the provision of a lifesaving device of the aforementioned character in which the staff of the man-overboard flag is sufficiently flexible to permit it to be coiled upon itself in adjacency to the life buoy so that it may automatically extend into erect position when it is pulled from the support in conjunction with the life buoy.

Another object of my invention is the provision of a severable lanyard as part of the connecting means between the life buoy and the support, whereby, while the lanyard will sustain the force to which it is subjected by the towing of the trailing line, it will sever automatically when the greater load of a man overboard is imposed thereupon.

An alternative form of the releasable connecting means can be provided as a vertical coil spring into which is inserted a calibrated stud, the spring resisting release of the stud under the load of the trailing line but the calibrated stud being separable from the spring when the trailing line is grasped by an individual who has fallen overboard.

An additional object of the invention is the provision of a lifesaving device of the aforementioned character which includes an auditory signal emitting device which is mounted on the support and which is connected to the life buoy so that, when the life buoy and the associated gear is pulled from the support, an auditory signal will be generated which will cause the remainder of the crew to be apprised of the existence of a man-overboard situation. Thus, the alarm signals the crew to return for the overboard man.

A further object of the invention is the provision, in a lifesaving device of the aforementioned character, of a light-emitting device, such as a strobe light, connected to the life buoy and adapted to be pulled therewith from the associated support and to indicate, at night, the location of the overboard individual.

Another object of the invention is the provision in the aforementioned device of engine kill or gear release means whereby, in a power boat, the engine will be killed, or, in a sail boat, the main sheet or other gear will be released.

Other objects and advantages of the invention will be apparent from the following specification and the accompanying drawings, a description of which appears hereinbelow.

DETAILED DESCRIPTION OF THE INVENTION

Figure 1:
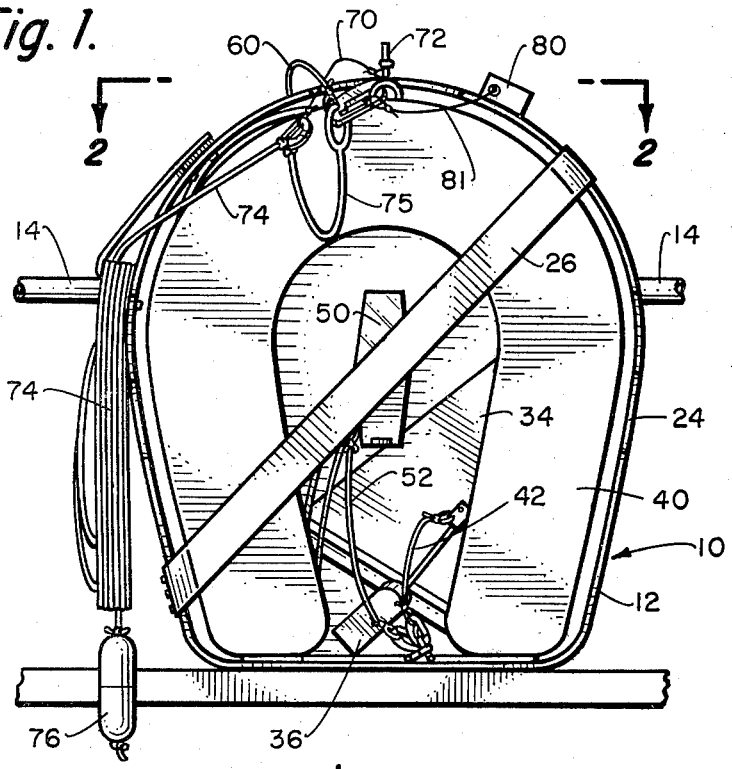
FIG. 1 is a front elevational view showing the lifesaving apparatus of the invention in standby condition.
Figure 3:
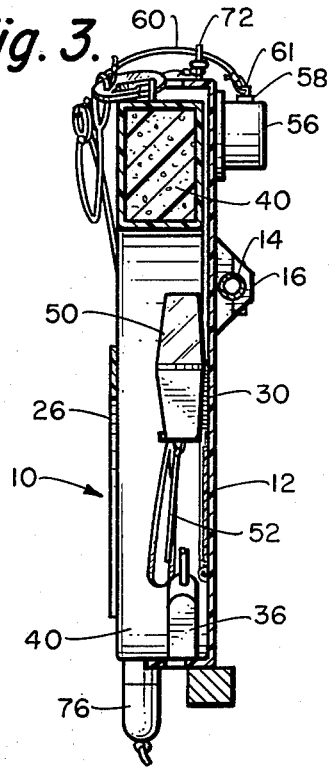
FIG. 3 is a vertical sectional view taken on the broken line 3—3 of FIG. 2.
Figure 2:
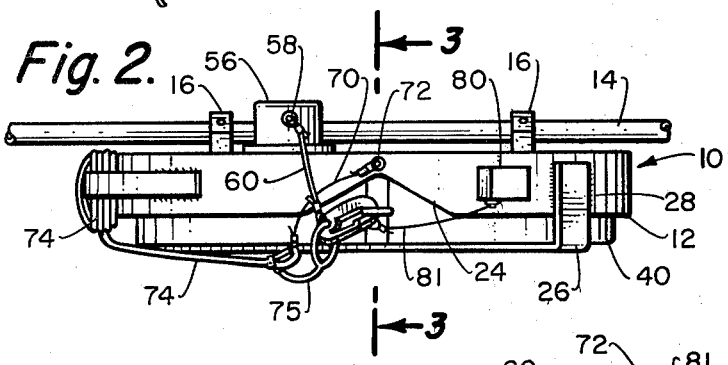
FIG. 2 is a top plan view taken from the broken line 2—2 of FIG. 1.

Referring to the drawings, and more particularly, to FIGS. 1-5 thereof, I show a lifesaving apparatus 10 constructed in accordance with the teachings of my invention and including a supportive housing 12 which may be fabricated from any desired material, such as artificial resin reinforced fiberglass, or the like.

Figure 5:
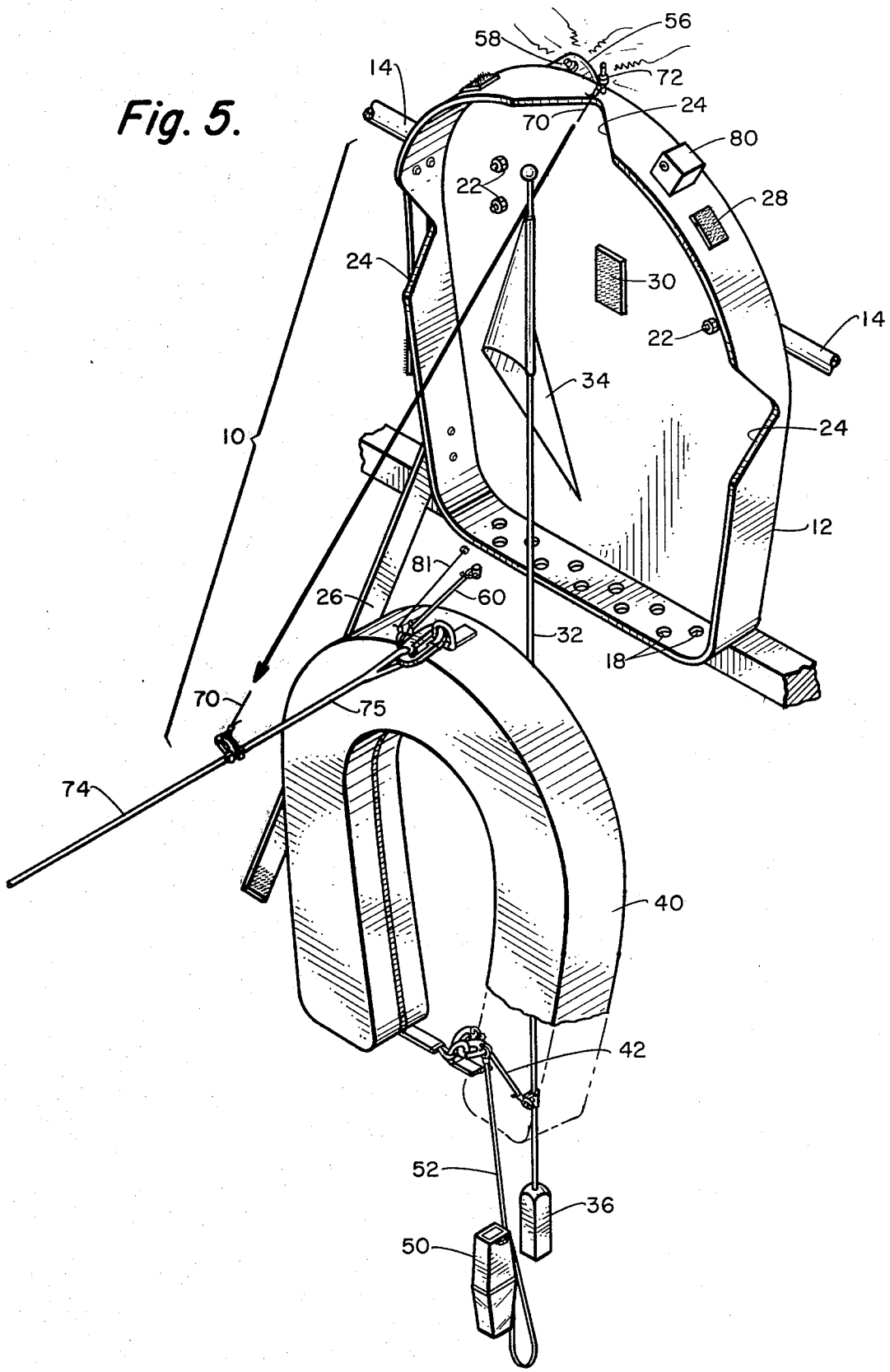
FIG. 5 is a view with the life buoy of the lifesaving apparatus shown as being pulled from the support in conjunction with the other components of the lifesaving apparatus.
Figures 6, 7, 8:
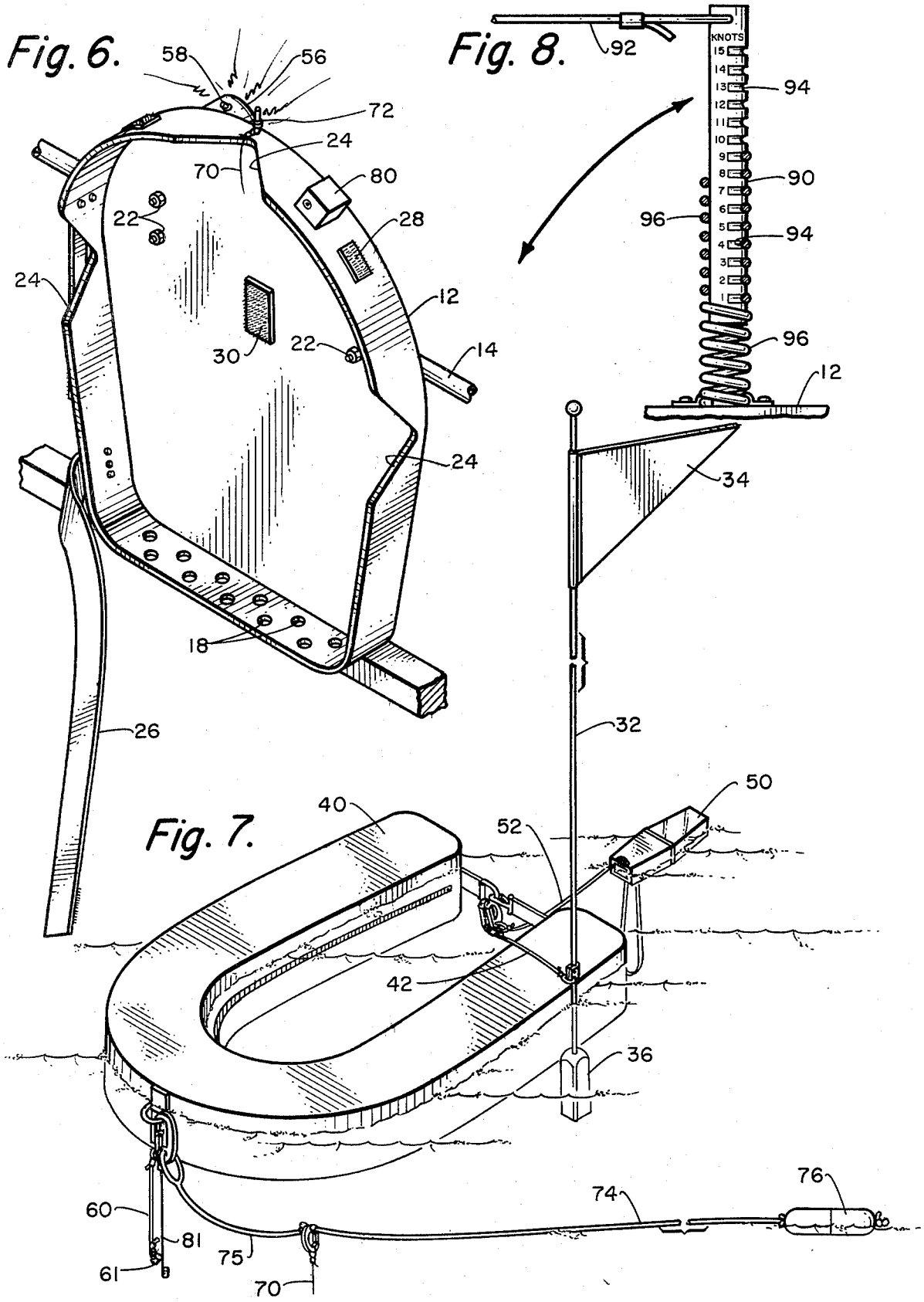
FIG. 6 is an isometric view illustrating the condition of the supporting enclosure after the apparatus has been operated.
FIG. 7 illustrates the various components after they have been drawn into the water by a man overboard.
FIG. 8 is an enlarged fragmentary view of an alternative form of connecting means utilized in conjunction with the lifesaving apparatus.

The supportive housing 12 is secured to a safety rail 14 of a vessel by means of attachment clamps 16. The housing 12, as best shown in FIGS. 5 and 6 of the drawings, includes drain holes 18 to permit water to drain from the supportive housing. Also shown in FIG. 6 are the securement nuts 22, which serve to maintain the attachment clamps in operative relationship with the rail 14.

A plurality of cutouts 24 is provided in the perimeter of the housing to facilitate the installation of the various other components of the apparatus in operative relationship with the housing and to facilitate visual perception of the presence or absence of the life buoy to be described hereinbelow.

Suitably secured adjacent the lower extremity of the housing 12 is a flexible retention strap 26, which has its upper extremity engageable with a retention pad 28, FIG. 6, which may be made of a material sold under the trademark Velcro. A cooperative pad is provided on the upper extremity of the retention strap 26. Another Velcro pad 30 is mounted centrally of the supportive housing 12 for a purpose which will be described in greater detail below.

Although I have described the utilization of a particular type of securement means to maintain the other components of the apparatus in operative relationship with the supportive housing 12, it will be obvious to those skilled in the art that a wide variety of different types of fastening means, including snap fasteners and the like, may be utilized in substitution for the Velcro fasteners. Included among the components of the apparatus is a flexible man-overboard pole 32, having a pennant 34 provided on its upper extremity. Since the staff of the man-overboard pole 32 is flexible and resilient, being formed of resin impregnated fiberglass or similar materials, it can be coiled upon itself into the stored within the housing 12 position most clearly shown in FIG. 4 of the drawings. Therefore, the conventional affixation of the man-overboard pole in an erect position in a support secured to a shroud or railing of the vessel is eliminated, and the entire assembly of the man-overboard pole is neatly coiled within the supportive housing 12.

Mounted within the supportive housing 12 in overlying relationship with the man-overboard pole 32 is a U-shaped life buoy 40 of conventional configuration, which is connected to the man-overboard pole 32 intermediate its extremities by a lanyard 42.

Mounted on the rear wall of the supportive housing 12 is a floatable, waterproof stroboscopic emergency light 50 which can be maintained in its centrally located position by the use of Velcro or an adhesive fastening means so a lanyard 52 also connects the stroboscopic light to the life buoy 40.

Mounted on the supportive housing 12 is an auditory emergency signal emitting device 56, which incorporates a toggle switch 58 connected by a line 60 having a cap 61 connected to it which overlies the toggle switch 58 and is pulled off to energize the device 56 when the buoy 40 leaves the housing 12 as best shown in FIGS. 1-5 of the drawings. Consequently, when the apparatus is pulled from the associated housing 12, a corresponding auditory signal will be generated by the device 56 to alert the crew of the vessel to the fact that a man has gone overboard.

Connecting means for the entire assembly is provided in the form of a break-away line or lanyard 70, which is secured to a post 72 on the housing and is also secured intermediate the extremities of an elongated trailing line 74 to form a bight 75 in the line 74 which is normally streamed aft of the vessel when the vessel is at sea. One or more highly visible loading buoys 76 are secured to the line in order to provide a visual indication of the line and to assist a man overboard in picking up the line. Buoys 76 can be provided in various configurations which will cause them to provide visual indication because of the rooster tail or the disturbance they cause by being pulled through the water. They can also be painted with fluorescent paint or formed from plastics incorporating fluorescent pigments to facilitate their perception by a man overboard.

When the line 74 is not in use, it is coiled upon itself and mounted on the side of the supportive housing 12.

Supported upon the upper perimeter of the housing is an enclosure 80 for an automatic engine killing device which is also connected to the life buoy and the trailing line 74 by means of a lanyard 81. The function of this engine killing device will be described in greater detail hereinbelow, but it is adapted to be simultaneously energized with the auditory signalling device 56 when a man goes overboard. The auditory signal emitting device 56 could be combined with the engine killing device or a sail release device, if desired.

Immediately upon leaving port, the line 74 is streamed astern of the vessel, and the buoy or buoys 76 are trailed at the end of the line 74, providing, if desired, a rooster tail or other visual indication of their passage through the water. It is also contemplated that the buoys 76 will be of plastic material embodying highly visible fluorescent type pigments. They also help to support the line 74 on the water surface.

Figure 4:
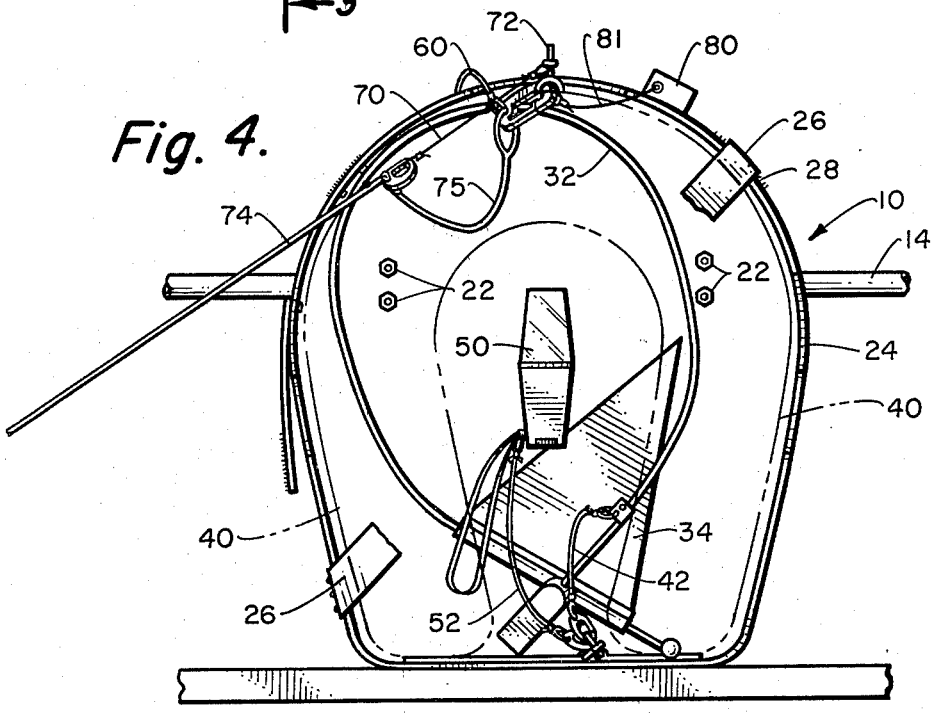
FIG. 4 is a front elevational view.

When the line 74 is streamed astern, the load of the line and the buoy 76 are sustained by the break-away line or lanyard 70 as best shown in FIG. 4. A 25-pound test break-away line or lanyard 70 will permit the trailing line 74 and buoy 76 to be streamed astern at 9 knots. Of course, if greater speeds are encountered, a higher test break-away line or lanyard 70 can be utilized.

Therefore, when a man falls overboard, he immediately heads for the line 74 and is assisted in so doing by perception of the buoy 76. The line 74 is streamed far enough astern to permit it to be grasped at the speed at which the vessel is traveling under difficult swimming conditions. When the line 74 or buoy 76 is grasped by the man overboard, the break-away line or lanyard is severed by the drag of the man, and the entire apparatus is pulled into the water. The strap 26 is torn loose and the buoy 40, man-overboard flag staff 32 and pennant 34, and strobe light 50 are pulled along with the buoy.

When the buoy hits the water, the lanyard 42 maintains the man-overboard pole 32 and flag or pennant 34 in operative relationship with the buoy 40, and the weight 36 causes the pennant 34 to be automatically pivoted upwardly, as best shown in FIG. 7 of the drawings.

At the same time that the life buoy 40 is being pulled from the supportive housing 12, the auditory signal generating device 56 is activated, which immediately advises the remaining crew members of the loss of the man overboard and causes them to take immediate action to recover him. Simultaneously, the engine-kill device 80 is energized in a manner similar to that in which the auditory signal-generating device is energized to cause the engine of the vessel, if it is operating under power, to be stopped, thus preventing the vessel from traveling a substantial distance from the man overboard.

If the vessel is under sail, a rigging release means, such as a sheet release, can be energized in the same manner as the engine-kill device by the buoy 40 being pulled into the water, and the vessel under sail will immediately head up into the wind and cease its forward progress through the water.

The automatic engine-kill feature or rigging or sheet release feature is an important aspect of the invention when a single-handed sailor goes overboard since, if the vessel were to continue its forward progress under sail or power, the single-hander would be lost despite the fact that he had utilized the automatic lifesaving device.

An alternative form of connecting means is shown in FIG. 8 of the drawings and consists of a connecting stud 90 which is secured by a line 92 to the trailing line 74. The stud 90 incorporates a plurality of serrations 94 which are received in a coil spring 96 secured to the perimeter of the housing 12. The serrations are calibrated in knots so that the connecting means can be set to resist the pull of the trailing line 74 under normal conditions.

The compressive force of the spring 96 in its relationship to the serrations 94 is so calculated that the stud 90 will not be dislodged from the associated spring 96 under the normal load of the trailing line and buoy. However, when a man overboard grasps the trailing line, the stud 90 is released from the spring 96 and the entire apparatus can be pulled by the man overboard into the water.

Once the rescue of the man overboard has been accomplished, all of the components can be reassociated with and stored in the housing 12, with the various connections being made to the housing and between the buoy and the other components of the apparatus.

I claim:

1. In a lifesaving apparatus for unassisted utilization by an overboard person, the combination of: a support securable to a portion of a boat which is accessible to the surface of the body of water being traversed by said boat; a life buoy mounted on said support; a trailing line connected to said life buoy and towed behind said vessel as said vessel traverses said water surface; and connecting means for removably securing said life buoy to said support, said connecting means being capable of sustaining the load imposed thereon as said trailing line is towed by said vessel through the water but being separable when the drag of an overboard individual, grasping the line, is imposed upon said trailing line to cause said life buoy to be released from said support and rendered accessible to said overboard person.

2. A lifesaving device of the character defined in claim 1 in which said connecting means includes a severable lanyard which sustains the load of the trailing line but which severs when the drag of an overboard individual is impressed upon said line.

3. A lifesaving device of the character defined in claim 1, in which said connecting means includes a spring release capable of sustaining the load imposed upon said trailing line by its being towed through the water but releasable when the weight of an overboard individual is impressed upon said trailing line.

4. In a lifesaving device for an overboard, unassisted individual, the combination of: a support securable to a portion of a vessel traversing the water surface which is accessible to said water surface; a life buoy on said support; a man-overboard flag having an elongated flexible shaft maintained in coiled condition on said support adjacent said life buoy, said man-overboard flag having a pennant at its upper extremity and a counterweight at its lower extremity and being connected intermediate said extremities to said life buoy; a trailing line connected to said life buoy and towable behind said vessel and seizeable by an overboard individual without assistance of on-board personnel; and connecting means connecting said trailing line to said support, said connecting means resisting the load imposed thereupon by the towing of said trailing line on the surface of the water but being releaseable by the load of an overboard individual impressed upon said line.

5. A lifesaving device of the character defined in claim 4 in which said line pulls said man-overboard flag and said buoy simultaneously from said support when said line is seized by an overboard individual and said man-overboard flag automatically pivots upwardly about its connection to said life buoy to raise said pennant above the surface of the water.

6. A lifesaving device of the character defined in claim 4 in which an auditory signaling device is connected to said life buoy whereby, when said life buoy and man-overboard flag are dislodged from operative relationship with said support, said signaling device will emit an auditory signal to alert the vessel's crew to the man-overboard contingency.

7. In a lifesaving device for facilitating the unassisted rescue of an overboard individual, the combination of: a supporting enclosure securable to a vessel traversing the surface of the water in proximity to said water surface; a life buoy releasably supported in said enclosure; a man-overboard flag in said enclosure secured to said life buoy; a trailing line secured to said life buoy and towable behind said vessel for seizure by an overboard individual; and releasable connecting means connecting said life buoy to said support, said releasable connecting means resisting the load impressed on it by the trailing line but being releasable when an overboard individual grasps said trailing line for withdrawing said life buoy and said man-overboard flag from said enclosure.

8. A lifesaving device of the character defined in claim 7 in which said man-overboard flag is secured to said life buoy and includes a pennant at one extremity and a counterweight at its other extremity whereby when said life buoy hits the surface of the water the man-overboard flag will automatically pivot upwardly to raise said pennant above the surface of the water.

9. A device of the character defined in claim 7 in which said man-overboard flag includes a flag staff which is flexible and which is coiled upon itself within the confines of said enclosure in adjacency to said life buoy.

10. A device of the character defined in claim 7 in which said enclosure has an auditory signaling device mounted thereupon and connected to said life buoy so that, when said life buoy is pulled from said enclosure in conjunction with said man-overboard flag, an auditory signal will be created which will signal to the vessel personnel the existence of an emergency man-overboard situation.

* * * * *